United States Patent [19]

Seaberg

[11] Patent Number: 4,739,886

[45] Date of Patent: Apr. 26, 1988

[54] PIERCED EARRING HOLDER

[76] Inventor: David G. Seaberg, 3167 Shorewood Dr., Arden Hills, Minn. 55112

[21] Appl. No.: 23,694

[22] Filed: Mar. 9, 1987

[51] Int. Cl.[4] ..... A47F 7/00

[52] U.S. Cl. ..... 211/13; 206/486

[58] Field of Search ..... 211/13, 163, 189; 248/222.4, 450, 220.3, 304; 206/486

[56] References Cited

U.S. PATENT DOCUMENTS

| | | | |
|---|---|---|---|
| 2,100,421 | 11/1937 | Wupper | 248/220.3 X |
| 2,621,429 | 12/1952 | Teich | 211/163 X |
| 2,937,758 | 5/1960 | Cabb | 248/220.3 X |
| 3,592,343 | 7/1971 | Swett et al. | 211/13 |
| 3,718,260 | 2/1973 | Sharp | 211/13 |
| 3,931,894 | 1/1976 | Murphy | 211/163 X |
| 3,997,050 | 12/1976 | Patterson | 211/163 X |
| 4,372,450 | 2/1983 | Licari et al. | 248/304 X |
| 4,531,638 | 7/1985 | Jacobozzi et al. | 248/450 X |

*Primary Examiner*—Robert W. Gibson, Jr.

[57] ABSTRACT

An jewelry holder comprising an upright standard including a plurality of tapered keyhole-like slots wherefrom a variety of types of earrings may be supported. In one embodiment, the holder comprises a slotted, planar upright including a plurality of integral, outwardly extending hook arms which mounts to a base tray.

8 Claims, 3 Drawing Sheets

PIERCED EARRING HOLDER

BACKGROUND OF THE INVENTION

The present invention relates to jewelry displays and storage devices and, in particular, to a slotted device capable of supporting pierced earrings of all available fastener designs.

A variety of devices for displaying and storing jewelry and, in particular, earrings have been developed over the years for personal and commerical use. While most facilitate the storage of jewelry, those which provide for a variety of drawered compartments and the like do not adequately display the contained jewelry for the wearer's inspection. Such a deficiency is particularly troublesome for the pierced earring wearer who may own fifty or more pairs of earrings which, even if not combined with other jewelry, are difficult to select from when randomly stored in a single or even smaller compartments. Accordingly and especially for long dangling earrings, it is preferably that each pair of earrings be separately mounted in some fashion to be readily viewable and not become entangled.

One holder of which Applicant is aware relative to the mentioned cabinet type storage device is U.S. Pat. No. 3,930,702. Again, though, such devices are believed deficient for the mentioned reasons. Other holders which more advantageously meet the pierced earring wearer's needs can be found in U.S. Pat. Nos. 4,181,224; 4,420,084 and 4,465,179. While each of these latter references disclose exposed support surfaces, they are principally directed to holders for earrings including a rigid stud and flexible clasp. Each earring consequently is attached to the holder by inserting the stud or post portion through the holder surface, before separately attaching the clasp to the post on the back side of the holder. Although, providing similar results to the present invention, such a mounting is oftentimes inconvenient and/or it is difficult to locate one post among many as the clasp is attached.

It is to be appreciated, though, that other earrings are available which are not fastened in this manner. Instead, they may include an S-shaped mounting bend or the earring itself may comprise a hoop, among some of the known different designs. Accordingly and even though the foregoing pierced earring holders provide advantages over cabinet holders, they still do not accommodate all types of earrings.

One other display holder of which Applicant is aware is disclosed in U.S. Pat. No. 4,531,638. It discloses a display member including a plurality of elongated slots which hold stacked flowers and other remembrances and curios, as opposed to pierced earrings. Although constructionally similar in the broad sense of the present earring holder, it is intended for a different use and, furthermore, does not permit an orderly removal of the displayed items nor provide many of the advantages of the present holder which will be described in greater detail hereinafter.

SUMMARY OF THE INVENTION

It is accordingly a primary object of the present invention to provide for a pierced earring holder which accepts and accommodates all available types of pierced earrings and fasteners.

It is a further object of the invention to provide a holder which permits pair mounting in a planar display so that multiple pairs may be simultaneously viewed.

It is a still further object of the invention to permit mounting post/clasp earrings without having to remove and separately attach the clasps.

It is a still further object of the invention to provide a stable, aesthetically pleasing holder configuration which minimizes against spillage and/or tipping.

It is a still further object of the invention to provide other means for storing other jewelry and/or temporarily catching earrings, prior to board mounting.

The foregoing objects and advantages are particularly accommodated in the present invention wherein a planar support member including a plurality of tapered, elongated keyhole slots are provided for receiving individual pairs of earrngs. Each slot includes a relatively large entrance portion and an adjoining narrow, tapered slot, whereby earrings may be mounted to the support with or without the clasp fasteners attached.

In its preferred embodiment, the invention comprises a planar plastic upright member including a plurality of slots. Postioned along the peripheral edges are a plurality of integrally formed hook members for receiving hoop-type earrings. A base member including at least one recessed compartment receives and retains the upright member thereto. In particular, a channeled slot is provided which includes resilient projections which extend into the channel and interlock with mating recesses formed in the bottom of the upright member.

The foregoing objects, advantages and distinctions of the present invention, among others, along with the detailed construction thereof, will be described hereinafter with respect to the appended drawings. Before referring thereto, it is to be appreciated the following description is intended to be illustrative only of the presently preferred embodiment and should not be interpreted in any respect in limitation of the full scope of the invention. To the extent modifications or other alternative embodiments have been contemplated, they are described and referenced as appropriate in the description. The following invention should accordingly be interpreted to include all those equivalent embodiments within the spirit and scope of the following description and claims.

DESCRIPTION OF THE PREFERRED EMBODIMENT

Figure 1:
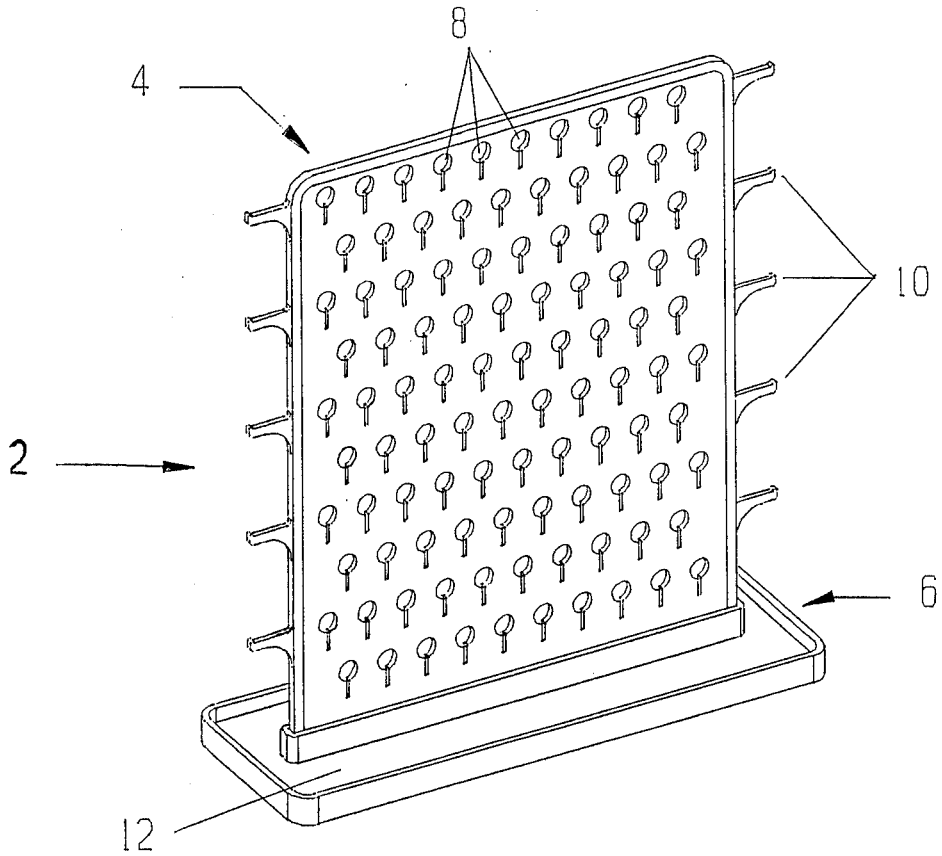
FIG. 1 shows an assembled perspective view of the present invention.

Referring to FIG. 1, an assembled perspective view is shown of the present pierced earring holder 2 which is generally comprised of a vertically upright earring support member 4 which is detachably or permanently mounted to a base support tray member 6. The construction of the earring holder 2 provides advantages over other available holders in that it permits the mounting of all types of earrings thereto. That is, post earrings including clasp fasteners may be mounted to any of the plurality of slotted holes 8 provided over the exposed surface. S-shaped or other bent post earrings may also be mounted to these slots 8. Hoop-type earrings, in turn, may be mounted to the integral arms 10 which extend from the sides of the support 4. Consequently, the holder 2 accommodates all types of available earrings.

Other jewelry may also be stored and displayed with the holder 2 by way of the base member 6 which includes a concentric recessed tray area 12 that surrounds the upright member 4. Bracelets, necklaces and the like may be stored therein in a conventional fashion or, alternatively, the tray 12 may be constructed with a plurality of segmented recesses for receiving and compartmentalizing such jewelry. For that matter, the tray 12 finds advantage as a temporary storage area, such as when first removing the earrings, prior to re-positioning them on the upright member 4 for later wearing. Consequently, a wearer might allow several pairs of earrings to collect in the tray, before remounting them on the upright 4.

Figure 2:
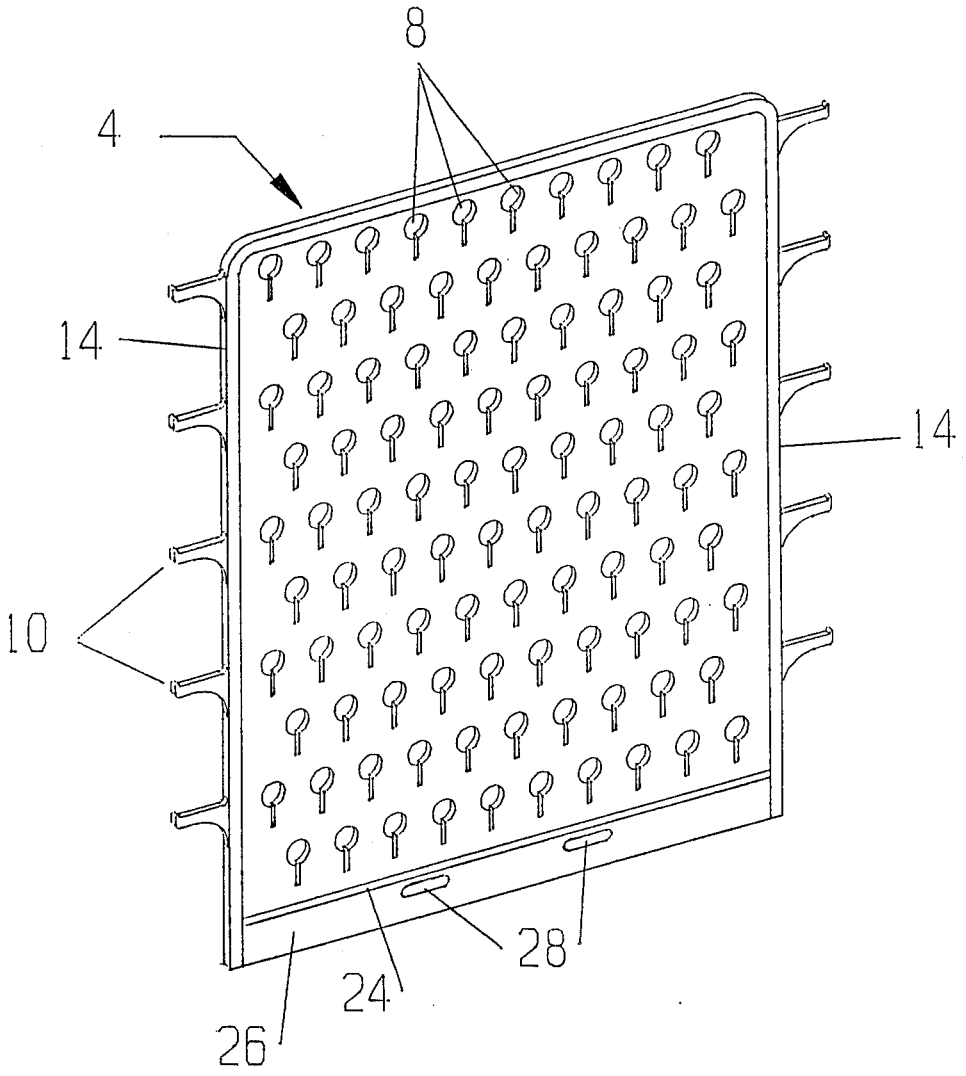
FIG. 2 shows a detailed perspective view of the slotted, hook-containing upright member.

With continuing attention to FIG. 1 and particular attention to FIGS. 2, 3 and 4, the construction of the upright member will now be described. Generally, it is comprised of a sheet of plastic, approximately 1/16 to ⅛ inch thick, which is injection molded to the generally rectangular shape shown. In lieu of a clear plastic, it is to be appreciated that a variety of colored plastics may be used equally as well, although translucent plastics facilitate mounting of the earrings.

The side and top edges 14 of the member 4 include a raised edge which stiffens and strengthens the support surface. It is to be appreciated, too, that additional raised ribbing might be formed in the field of the front and back surfaces to further enhance the structural rigidity of the member 4 so long as they can be incorporated into the overall design in an aesthetically pleasing manner. In this regard, small imprinted flowers (not shown) are formed in the field of the support at the points where the molder extraction pins contact the upright 4, as it is removed from its mold.

The plurality of elongated slots 8 are formed in the member 4 in offset rows with each being spaced approximately ⅜ inches from each other at their widest point and each row being spaced approximately 1 inch away from each other row. Each slot opening 8 is designed to present a keyhole-like appearance having a larger opening 16 at its upper end and a narrow elongated slot portion 18 extending vertically downward therefrom. The length of each slot portion 18 is sized to accept individual pairs of earrings, just as the opening 16 is sized to permit a typical post/clasp fastener to be passed therethrough. Consequently, an earring wearer may separately attach each earring's fastener to the post, prior to mounting it on the upright 4. Alternatively, the earring post may be separately passed through the slot portion 18 so as to extend therebehind with the fastener being separately attached. For obvious reasons, it can be appreciated the former approach offers advantages over the latter, especially when the field of the upright 4 becomes filled with other earrings and it is difficult to locate the back of one hole, while viewing the front of the holder.

Figure 3:
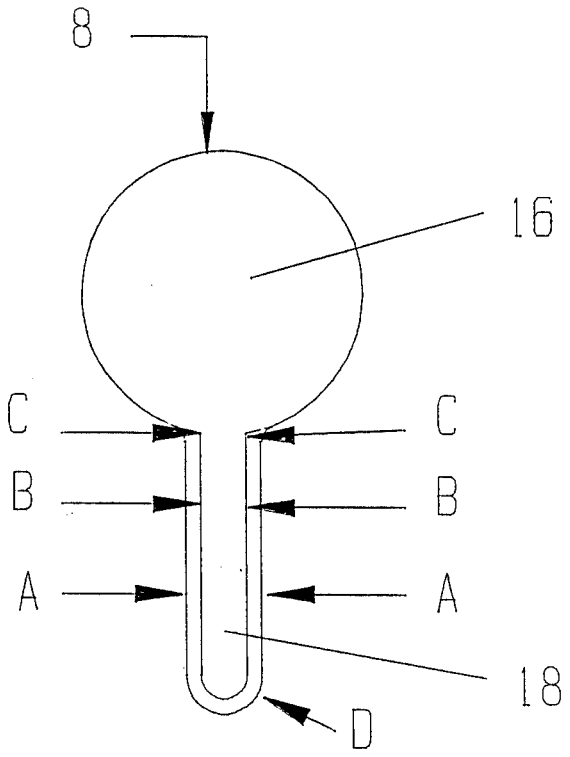
FIG. 3 shows a detailed perspective view in cutaway of one of the slots.

With still further attention directed to FIG. 3, a detailed perspective view is shown in cutaway of one of the slots 8, although it is to be appreciated that all of slots are similarly formed. In particular, from this view it is to be appreciated that each slot 8 is formed such that its side walls taper inwardly from the front of the upright 4 to its back surface. Consequently, the width of the front side of slot portion 18 as designated by the "A" dimension is wider than the width of the slot as it opens on the back surface and as designated by the "B" dimension. Specifically, a 0.010 taper is presently provided, although more or less may be employed, just as the slot 18 may be vertically tapered by being wider at its opening to the aperture 16 than at its base and as respectively designated by dimensions "C" and "D". Such slotting facilitates the mounting of each earring by providing a relatively large aperture 16 for easily receiving each earring but which progressively tapers down to confine each earring in a space configured to be less conducive to jostling or other movement which might otherwise displace earrings therefrom. Still further and in lieu of a single slot portion 18, it is to be appreciated that other slot portions 18 might angulate downwardly from each opening 16, such that multiple pairs are accommodated at each opening 16. Each earring pair is thus readily accessible, without having to pick through multiple pairs from a stack of earrings mounted along a common slot portion 18. Still further, the slot portion 18 may include a curved or slightly bent portion adjacent the opening 16, before becoming more vertical, thereby minimizing against spillage upon tipping or transport of the holder 2.

Figure 4:
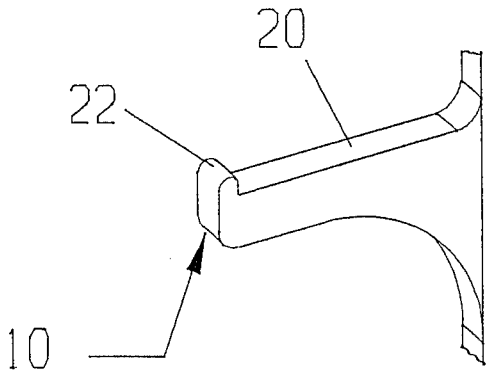
FIG. 4 shows a detailed perspective end cutaway of one of the hook arms.

Returning attention to FIG. 2 and also referring to FIG. 4, it is to be noted that each arm 10 extends outwardly from the sides of the member 4 to provide an upper horizontal support surface 20 having a hooked outer tip 22. The underside of each arm 10 is arcuately formed to provide structural rigidity. Since most hoop earrings are of a relatively large diameter it is to be appreciated multiple hoops may be mounted along each hook, without the underside of each hook 10 affecting how close the hoop mounts to the side edge of the member 4. The outer raised lip 22, in any case, minimizes against dislodgement of the hooped earrings from side-to-side holder movement. Although depicted with a flat horizontal region 20, it is to be further appreciated the hook members 10 may be constructed in any number of shapes with more or less exaggeration at the tip 22 to prevent against dislodgement.

Returning attention to FIG. 2 and in particular directing attention to the bottom edge of the upright 4, a raised horizontal rib member 24 is provided along the front and back surfaces which limits the insertion depth of the upright 4 into the base member 6. Alternatively, the lower edge portion 26 might be thinner and create a ledge where it meets the upper portion of the member 4 or even include a plurality of fingered projections. The primary objective is that it mounts in interlocking mating relation to the base member 6.

As presently constructed, the edge portion 26 is, with the exception of the stop rib 24, the same thickness as the reaminder of the upright 4. Provided also in the edge portion 6 are a pair of elongated through slots 28 which interlock with fasteners provided in the base member 6. Alternatively, such slots may be deleted or, instead of slots, projections might be included to interlock with slots in the base member 6. In any case, the slots 28 and stop rib 24 facilitate mounting and support of the upright 4 within the base member 6.

Figure 5:
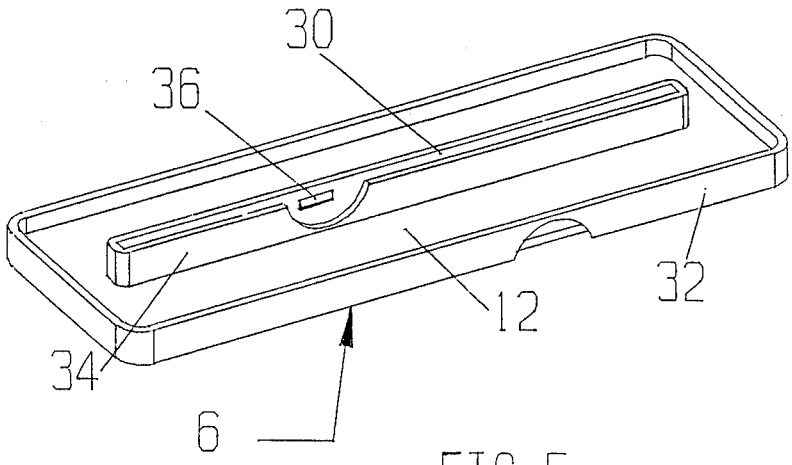
FIG. 5 shows a detailed perspective view in partial cutaway of the base tray member.

In this latter regard, attention is lastly directed to FIG. 5 wherein a perspective view is shown in partial cutaway of the base member 6. Generally, it comprises an elongated rectangular plastic tray having side walls 32 which extend above the tray surface 12 and wherein an upright member receiving channel 30 is formed. The channel 30 is concentrically positioned relative to the tray with the channel forming side walls 34 extending upwardly from the tray surface 12 to a height slightly above that of the outer side walls 32. The relative heights may be adjusted, although the height of the bottom portion 26, as determined by the stop rib 4, is sized such that the upright 4 is received in the channel 30 and extends to a depth just above the surface upon which the holder 2 is placed.

The inner surfaces of the channel side walls 34 are further formed to include integral projections 36 which align with the slots 28, such that upon mounting the upright 4 to the base member 6, the projections 36 resiliently interlock with the slots 28. In lieu of the dimples shown, these projections may take a variety of shapes or, alternatively, slots may be formed in the side walls 34, with the projections 36 being formed in the upright member 4. Other raised projections may also be included to adjust for telerances and provide a snug fit between the upright 4 and base member 6.

Referring to the cutaway portion of the outer side walls 32, it is to be further appreciated that the tray surface 12 is slightly raised above the support surface, thus causing the weight of the holder 2 to be distributed about the points of contact of the side walls 32 to the table top, dresser top, etc.

As mentioned previously and in lieu of a single tray recess 12, it is to be appreciated that multiple compartments might be included by forming additional partition walls in the area of the tray 12. Still further, hinged covers (not shown) might be included to cover the tray area, such covers being hinged either along the side walls 34 or 32 with the cover shape being appropriately formed relative to the hinging and compartments.

By way of still other modifications to the invention, it is to be appreciated that in lieu of a single upright member 4, multiple members 4 may be mounted to a base member including multiple channels 30. Also, multiple members 4 might be hinge-mounted to one another or a rigid upright in the fashion of a book binding, whereby an earring owner may leaf through multiple earring containing members 4. Still further, each of a number of members 4 might be radially disposed about a center upright post member which, in turn, is rotatably mounted to a base member.

From the foregoing, it is to be appreciated that still other modifications and alternative embodiments may be conceived by those of skill in the art without departing from the spirit and scope of the invention. Accordingly, the following claims should be interpreted so as to include all those equivalent embodiments within the spirit and scope thereof.

What is claimed is:

1. Earring support apparatus comprising:

(a) a planar support member including a plurality of apertures receiving individual earring pairs formed through a front surface to a back surface thereof, wherein each aperture includes a first region of greater size than a second elongated region opening to said first region and wherein the side walls of the second region of each aperture uniformly taper inwardly from the front to the back surface;

(b) a plurality of integral arms extending outwardly from the sides of said support member and wherein each arm includes an outer end portion which extends above an inner support portion; and (c) means for securing said support member in vertically upright relation to a resting surface.

2. Earring support apparatus comprising:

(a) a vertical planar member having a plurality of slotted apertures, each aperture receiving a single earring and extending from a front to a back surface, wherein each aperture incudes a first region of an opening dimension permitting the partial insertion of each earring therethrough and a second elongated support region extending from said first region and wherein the side walls of each second region uniformly taper inwardly from the front to the back surface of said planar member; and (b) a base member including an integral, slotted planar member receiving channel wherein said planar member and the side walls of said channel include means for cooperatively securing said planar member to the base member.

3. Earring support apparatus comprising:

(a) a vertical planar member having a plurality of slotted apertures, each aperture receiving a pair of earrings and extending from a front to a back surface, wherein each aperture includes a first region of an opening dimension permitting the partial insertion of an earring therethrough and a second elongated region extending from said first region whereat each pair is supported and wherein the side walls of each second region taper inwardly from the front to the back surface of said planar member and from the opening to said first region to the outermost end of said second region;

(b) a plurality of integral arms extending outwardly from the sides of said support member and wherein each arm includes an outer end portion which extends above an inner support portion; and (c) a base member having a horizontally flat planar portion circumscribed at its outer edges by a vertical side wall portion, an upper edge of which extends above said flat portion, and includes an integral, slotted, walled channel forming portion wherein said planar member is restrained in upright relation to said base member and further includes means for interlocking said planar member with said base member.

4. Apparatus as set forth in claim 2 wherein the second region of each aperture is wider at its opening to said first region than at its opposed end.

5. Apparatus as set forth in claim 2 including a plurality of integral arms extending outwardly from the sides of said support member and wherein each arm includes an outer end portion which extends above an inner jewelry support portion.

6. Apparatus as set forth in claim 2 wherein said base member comprises a horizontally flat planar portion circumscribed at its outer edges by a vertical side wall portion, an upper edge of which extends above said flat portion, and includes a walled channel forming portion wherein said support member is restrained in upright relation to said base member and further includes means for interlocking said support member with said base member.

7. Apparatus as set forth in claim 6 including means for limiting the insertion depth of said support member in the base member channel.

8. Apparatus as set forth in claim 6 wherein said interlocking means comprises at least one slot formed along the bottom periphery of said support member and the walled channel portion includes at least one outwardly extending projection which mounts in said slot.

* * * * *